US008003909B2

(12) United States Patent
Gessler

(10) Patent No.: US 8,003,909 B2
(45) Date of Patent: Aug. 23, 2011

(54) EMERGENCY OFF SWITCHING DEVICE

(75) Inventor: Franz Gessler, Leutkirch (DE)

(73) Assignee: RAFI GmbH & Co. KG, Berg (DE)

( * ) Notice: Subject to any disclaimer, the term of this patent is extended or adjusted under 35 U.S.C. 154(b) by 283 days.

(21) Appl. No.: 12/291,801

(22) Filed: Nov. 13, 2008

(65) Prior Publication Data

US 2009/0218206 A1 Sep. 3, 2009

(30) Foreign Application Priority Data

Nov. 21, 2007 (DE) ..... 10 2007 056 191

(51) Int. Cl.
*H01H 9/00* (2006.01)

(52) U.S. Cl. ..... 200/334; 200/16 A; 200/308

(58) Field of Classification Search ..... 200/16 R–16 D, 200/520, 530, 534, 535, 334, 308
See application file for complete search history.

(56) References Cited

U.S. PATENT DOCUMENTS

| | | | | |
|---|---|---|---|---|
| 4,013,856 | A | 3/1977 | Joss et al. | |
| 6,198,058 | B1 * | 3/2001 | Graninger et al. | 200/50.02 |
| 6,930,267 | B2 * | 8/2005 | Chou | 200/520 |
| 7,309,840 | B1 * | 12/2007 | Lo | 200/293 |
| 7,488,914 | B2 * | 2/2009 | Kahnert et al. | 200/538 |
| 7,605,337 | B2 * | 10/2009 | Scherl et al. | 200/405 |
| 7,786,398 | B2 * | 8/2010 | Olbrich et al. | 200/334 |
| 2007/0137995 | A1 * | 6/2007 | Scherl et al. | 200/405 |
| 2008/0230358 | A1 * | 9/2008 | Olbrich et al. | 200/243 |
| 2009/0200145 | A1 * | 8/2009 | Scherl et al. | 200/303 |

FOREIGN PATENT DOCUMENTS

| | | |
|---|---|---|
| DE | 10314539 B4 | 1/2006 |
| DE | 102005033166 | 1/2007 |

* cited by examiner

*Primary Examiner* — Michael A Friedhofer
(74) *Attorney, Agent, or Firm* — Pandiscio & Pandiscio

(57) ABSTRACT

An emergency off switching device for disconnecting an electrically operated machine from a circuit including a plurality of operated machines, includes a housing attached to the machine against which an externally accessible actuator cap is held in an axially movable arrangement, a contact switch accommodated in the housing which is closed when the switching device is in the non-actuated condition and by means of which the machine is electrically connected to the circuit, and a driver sleeve supported against the inside of the housing that is connected to the actuator cap with the free end of the driver sleeve opposite to the actuator cap facing the contact switch and disconnecting it from the circuit in the actuated condition, wherein a monitoring signal is generated when the switching device is in the actuated condition, to ascertain which of a plurality of the switching devices has been actuated.

4 Claims, 4 Drawing Sheets

EMERGENCY OFF SWITCHING DEVICE

BACKGROUND OF THE INVENTION

1. Field of the Invention

The invention relates to an emergency off switching device for disconnecting an electrically operated machine from a circuit in accordance with the precharacterising clause of patent claim 1.

2. Description of the Prior Art

A switching device of this kind is disclosed in EP 103 14 539 B4. A switching device of this kind principally serves to shut off the electrically operated machine immediately in an emergency situation. Normally, the contact switch is decoupled from the electrical circuit by the actuator cap being pressed down, with the effect that the energy supply for the machine is interrupted. These switching devices are used in a large number of electrical devices, machines, control devices and the like.

It has proven to be a disadvantage with emergency off switching devices of this kind that it is often difficult to find out which of the many switching devices has actually been actuated. This is because, for example, if there is a large number of electrical devices installed in a machinery hall as part of one manufacturing process, and all of these have to be interrupted then the actuated switching device cannot be established directly, with the effect that there is a time delay before the equipment circuit can be put back into operation. This is because actuating the switching device switches off the entire interconnected and synchronised system. The monitoring and operating personnel therefore have got to check all of the switching devices installed in the system whenever one of the emergency off switching devices is actuated. Only when the actuated emergency off switching device has been deactivated, i.e. once it has been possible to terminate the emergency situation, should the machine or the system immediately return to operation in order to avoid any unnecessary downtimes.

SUMMARY OF THE INVENTION

It is therefore a task of the present invention to provide an emergency off switching device of the aforementioned kind such that, firstly, an electrically operated machine can be deactivated and switched off reliably in a circuit in an emergency situation and, secondly, the emergency off switching device configured in accordance with the present invention should generate an electrical monitoring signal by means of which it is possible without any time delay to detect which of the emergency off switching devices installed in a machine or a system has been actuated.

A contact bridge is provided in the driver sleeve, and this bridge activates a check switch when the switching device is in actuated condition, with the effect that an electrical signal that can be evaluated is produced, so that it is possible, for example, to detect by an external monitoring unit which of the emergency off switching devices installed in the machinery system has been actuated. This means the emergency off switching device can be deactivated without delay, therefore the downtimes of the system are reduced to a minimum because the time-consuming procedure of searching to see which of the existing emergency off switching devices has deactivated the system can be dispensed with.

It is particularly advantageous if the check switch that generates the monitoring signal is arranged in the centre of the switching device, specifically in a cavity within a driver sleeve, because it is normal for LED lights to be accommodated in the centre of the cavity in switching devices of prior art so that the switching device can be detected straightforwardly and therefore operated even if the room is dark or if visibility is impaired, for example by smoke or other environmental contamination. The switching device in accordance with the present invention can therefore be integrated into existing emergency off switching devices, because these can be equipped with the features in accordance with the present invention, in particularly with the check bridge in the centre of the switching device in order to generate the monitoring signal when the emergency off switching device has been actuated.

The illumination of the actuator cap for the emergency off switching device can be provided directly within the cap, with the effect that the actuator cap can still be located as before in an emergency situation. The resulting cavity in a conventional emergency off switching device can therefore be provided with the contact bridge in accordance with the present invention, with the effect that the feature in accordance with the present invention can be straightforwardly retrofitted to existing machinery, systems and devices.

BRIEF DESCRIPTION OF THE DRAWINGS

The drawings show a preferred embodiment configured in accordance with the present invention, in a sectional views, the details of which are explained below. In detail.

DESCRIPTION OF THE PREFERRED EMBODIMENTS

Figure 1A:
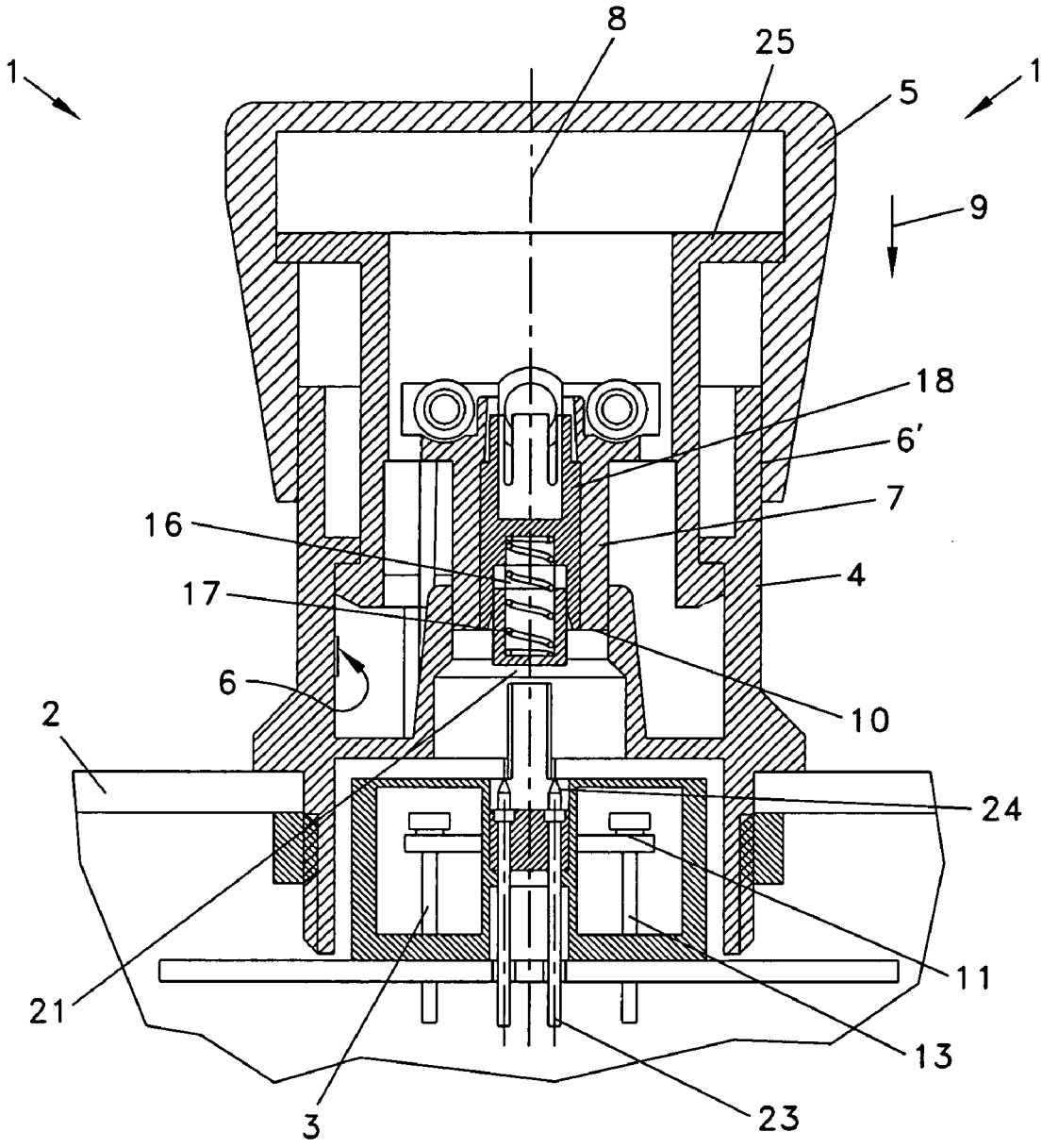
FIG. 1*a* shows an emergency off switching device consisting of a housing against which an actuator cap is disposed in an axially adjustable arrangement, and of a driver sleeve inside the housing and moveable in the direction of a contact switch, in a non-actuated condition.

FIGS. 1*a*, 1*b*, 2*a* and 2*b* show an emergency off switching device 1 by means of which an electrically operated machine 2 can be disconnected from an electrical circuit 3 in an emergency situation, with the effect that operation of the machine 21*s* stopped immediately. Machines of this kind form a machinery system that is internally synchronised within a working or manufacturing cycle. If one of the machines 2 in the working cycle is stopped, this means the entire machinery system must stop. Once the emergency situation has been cleared and terminated, the machinery system should be able to resume its operation without delay. For this purpose, it is necessary to know which of the switching devices 1 has actually been actuated so that the machine 2 can once again be connected to the circuit 3 and the entire machinery system returned to operation.

The switching device 1 comprises a housing 4 that is firmly connected to the machine 2, and on which an externally accessible actuator cap 5 is held so as to be able to move axially in the indicated movement direction 9. A driver sleeve 7 is arranged inside the housing 4 and is firmly connected to the actuator cap 5, which means it is pushed in the movement direction 9 of the actuator cap 5 when this is pushed axially. The driver sleeve 7 is supported and held in a guided arrangement against an inside surface 6 of the housing 4 and the same applies to the actuator cap 5 on the outside surface 6' of the housing 4. The actuator cap 5 and the driver sleeve 7 have a circular cross section. Furthermore, a guide sleeve 25 is disposed inside the housing 4 and is firmly connected to the actuator cap 5, and is supported on the inside surface 6 of the housing 4, which means the actuator cap 5 is additionally held in an axially guided arrangement on the housing 4. The actuator cap 5 is consequently brought into contact with several contact and guidance surfaces on the inside surface 6 and the outside surface 6' of the housing 4, which avoids tilting of the actuator cap 5 during the movement procedure. This results in the situation that in the event of an emergency, the actuator cap 5 can be moved reliably and without any time delay in the direction of movement 9, in order to disconnect the machine 2 from the circuit 3.

The circuit 3 runs in the area of the housing 4 that faces the machine 2, and the circuit 3 emerges in two conductors 13 that together form a contact switch 11. The contact switch 11 is closed in FIGS. 1*a* and 1*b*. This represents the non-actuated condition of the switching device 1; the actuator cap 5 is in its starting position.

Figure 1B:
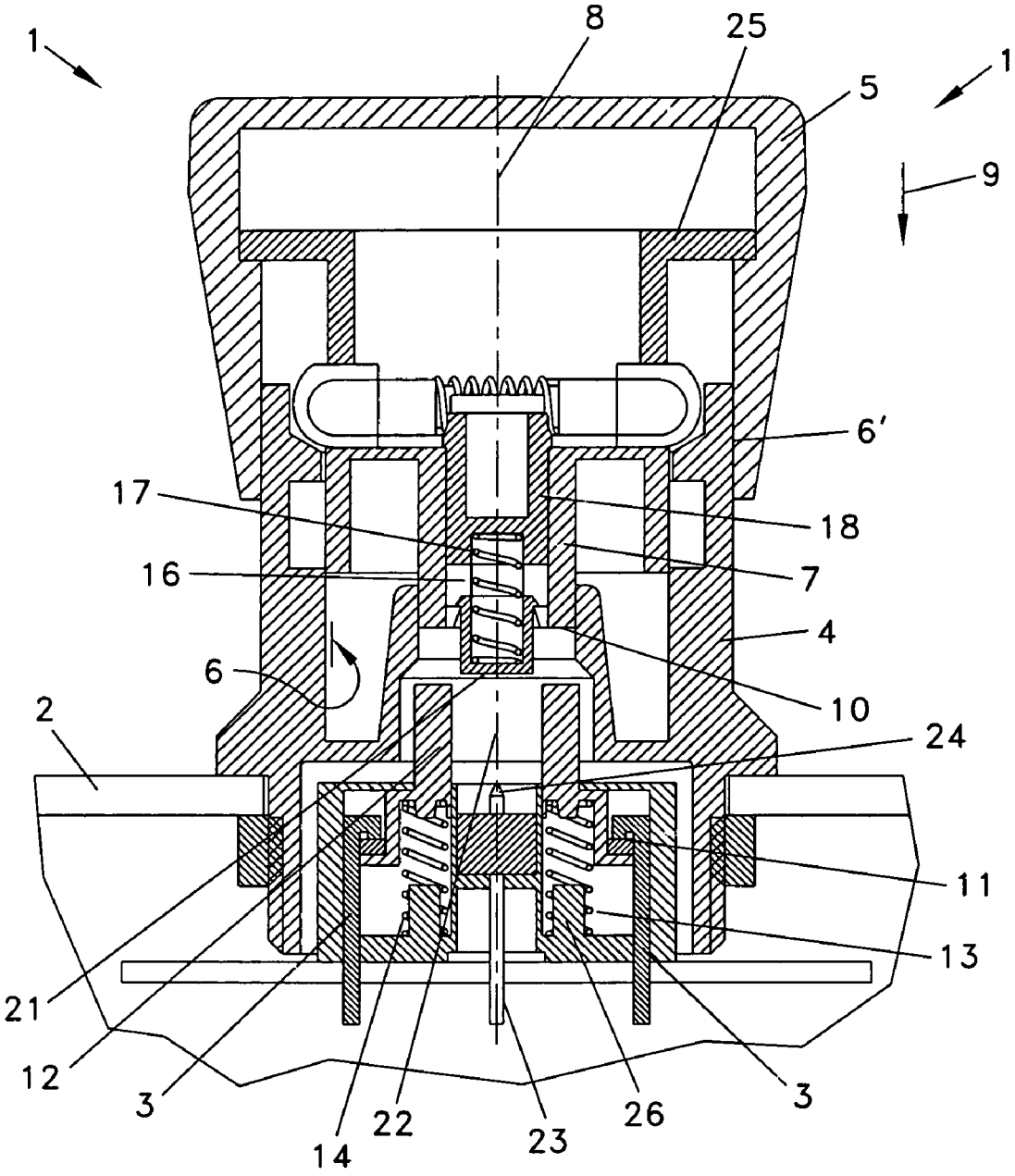
FIG. 1*b* shows the emergency off switching device in accordance with FIG. 1*a*, rotated through 90°.
Figure 2A:
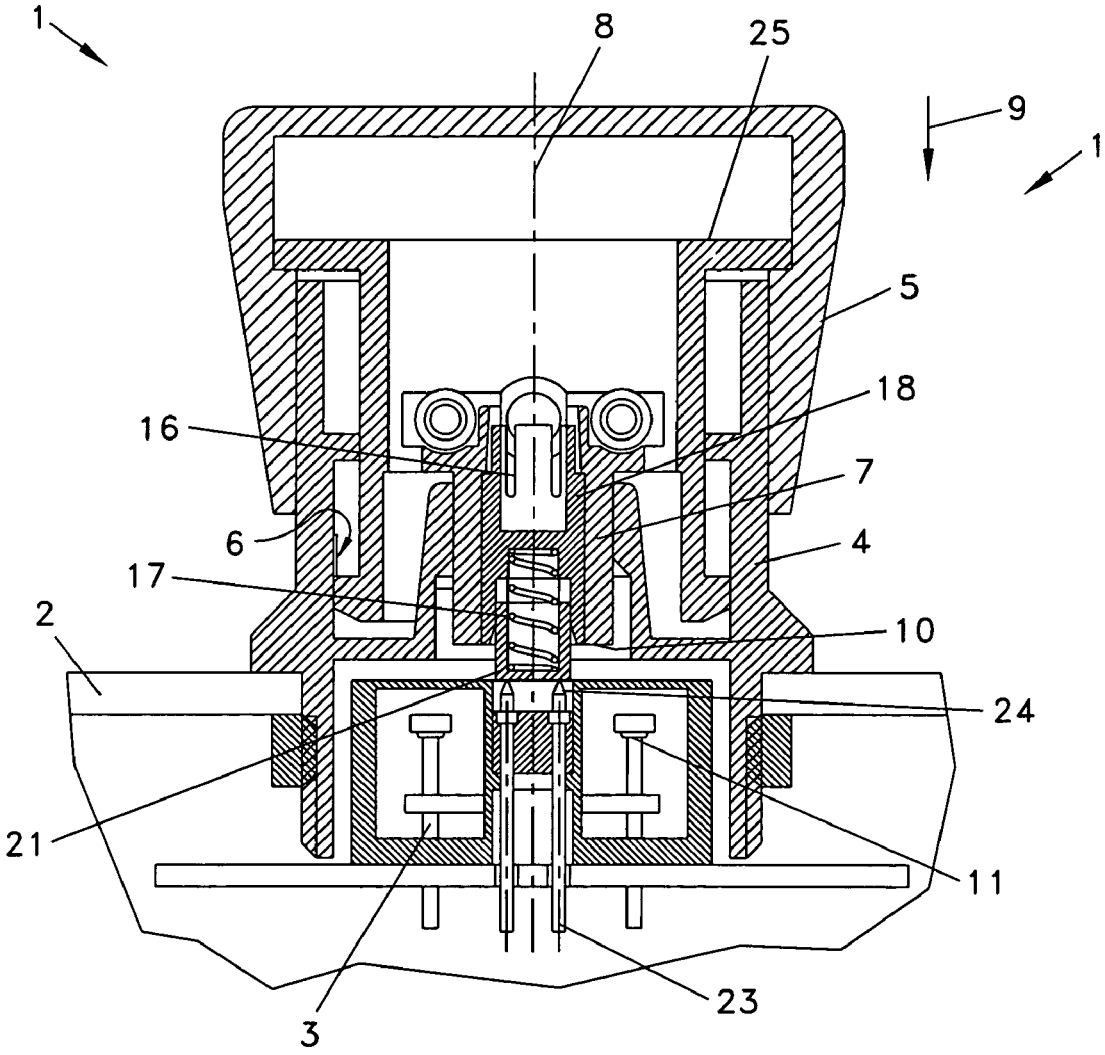
FIG. 2*a* shows the emergency off switching device in accordance with FIG. 1*a*, in the actuated condition.
Figure 2B:
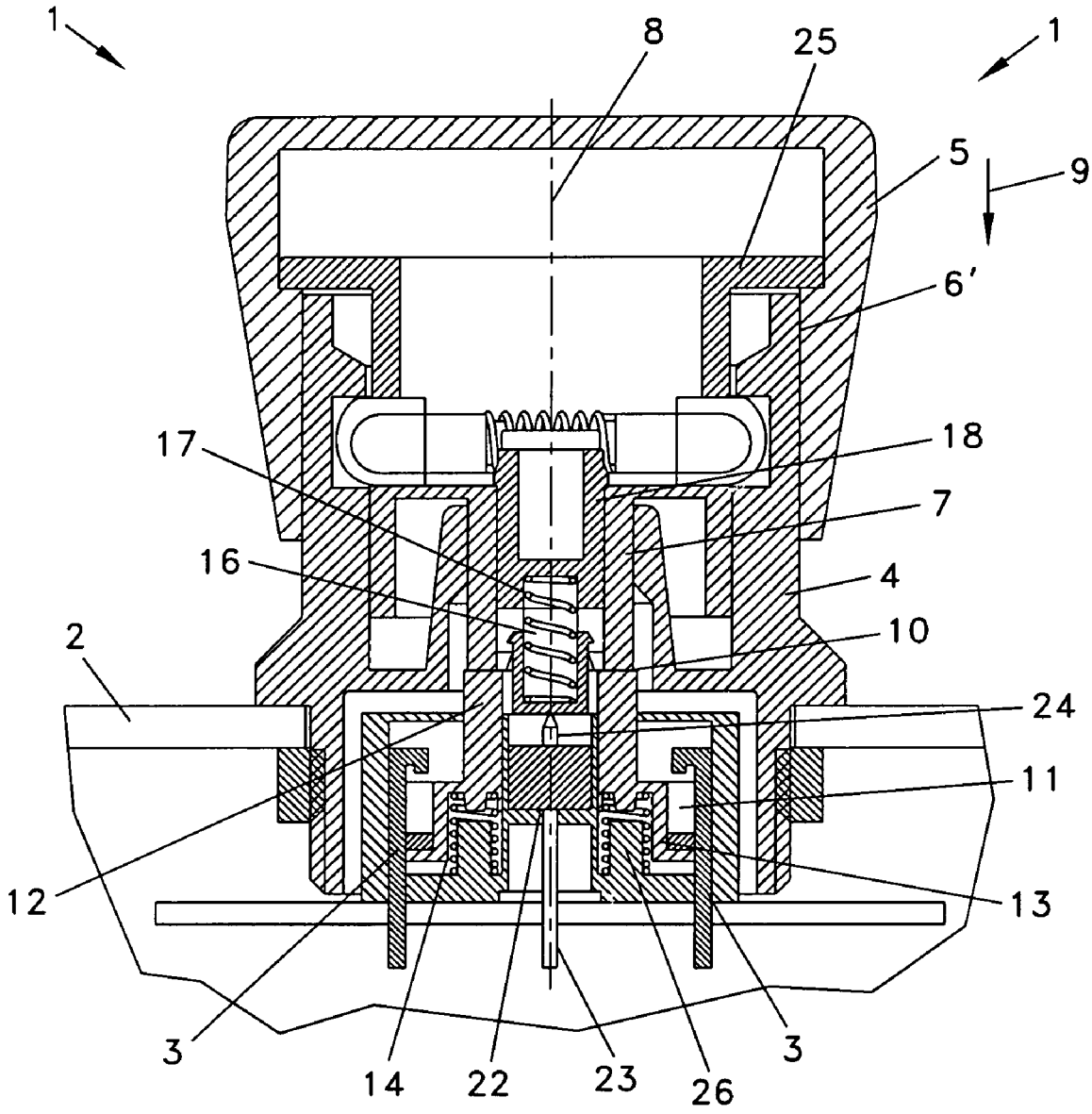
FIG. 2*b* shows the emergency off switching device in accordance with FIG. 1*b*, in the actuated condition.

The two L-shaped conductors 13 are connected together electrically by a switching sleeve 12 (FIGS. 1*b* and 2*b*). The switching sleeve 12 therefore functions as a switching element in order to close the contact switch 11 or, when actuated, to open the switching device 1. For this purpose, the switching sleeve 12 is configured so its free end opposite to the contact switch 11 is facing in the direction of the actuator cap 5 and the driver sleeve 7. In this case, the switching sleeve 12 is pressed in the direction of the actuator cap 5 and the driver sleeve 7 by the force of a spring 14. The force of the spring 14 is braced by the two conductors 13 that face one another with their legs that run horizontally. The other free end of the spring 14 is fixed onto two pegs 26 (FIGS. 1*b* and 2*b*) that are formed onto the housing 4.

FIGS. 2*a* and 2*b* show the switched or actuated condition of the switching device 1. The actuator cap 5 and the driver sleeve 7 are pushed in the direction of movement 9, i.e. in the direction of the contact switch 11. An end 10 of the driver sleeve 7 facing away from actuator cap 5, but facing the contact switch 11, runs flush with the free end of the switching sleeve 12. The longitudinal axis 8 of the housing 4 forms an axis of symmetry for the actuator cap 5, the driver sleeve 7 and the switching sleeve 12. When the actuator cap 5 is actuated and pressed down, which means the driver sleeve 7 is also pressed down, the end 10 of the driver sleeve 7 is brought into contact with the switching sleeve 12 (FIG. 2*b*), and lifts this off the two opposite conductors 13 against the force of the spring 14. This means the contact switch 11 is opened and the machine 2 is disconnected from the circuit 3, meaning that its energy supply is interrupted. A contact bridge 21 is disposed inside the driver sleeve 7, and the contact bridge 21 has a U-shaped cross section. A check switch 22 (FIG. 2*b*) is provided flush with the contact bridge 21 (FIG. 2*a*) in the area of the contact switch 11, with the check switch 22 being formed by two contact pins 24 (FIG. 1*a*) located at a distance from one another. The contact bridge 21 and the check switch 22 therefore form a check circuit 23 that is electrically separate from the contact switch 11, which means it forms a separate circuit.

In order to effect reliable and force-applied pressure by the contact bridge 21 on both contact pins 24 of the check switch 22, a holding bush 18 is disposed in a cavity 16 worked into the driver sleeve 7, and the holding bush 18 is configured with a U shape in the direction of the contact bridge 21. A spring 17 is disposed between the holding bush 18 and the contact bridge 21, by means of which the contact bridge 21 is pressed in the direction of the check switch 22, i.e., onto the free ends of the two contact pins 24.

Actuating the switching device 1 therefore causes the contact switch 11 to be opened by means of the actuator cap 5 and the driver sleeve 7 that is firmly connected to it, and the machine 2 is disconnected from the circuit 3 that supplies it with electrical energy. In addition to this, the check circuit 23 is made because the contact bridge 21 establishes an electrical connection between the two contact pins 24 of the check switch 22. This electrical connection generates a monitoring signal that can be detected in an external control unit and informs the operating personnel which of the switching devices 1 in a machinery system has actually been actuated. Therefore, as soon as the emergency situation has been cleared and dealt with, it is possible for the operating personnel to ascertain which switching device 1 was actuated and to deactivate it so as to be able to return the entire machinery system to operation once again.

What is claimed is:

1. An emergency off switching device (1) for disconnecting an electrically operated machine (2) from a circuit (3) including a plurality of electrically operated machines, and for immediately detecting and indicating that the device has been switched off for one of the machines, the switching device comprising a housing (4) adapted to be attached to the machine (2), an externally accessible actuator cap (5) mounted on said housing and disposed in an axially movable arrangement, a contact switch (11) mounted in said housing (4) and adapted to be closed when the switching device (1) is in a non-actuated condition and the machine (2) is electrically connected to the circuit (3), and a driver sleeve (7) supported against an inside surface (6) of said housing (4) and connected to said actuator cap (5), with a free end (10) of said driver sleeve (7) disposed opposite to said actuator cap (5) and facing said contact switch (11) and operable to disconnect said contact switch from the circuit (3) in an actuated condition, wherein a contact bridge (21) is locked within a cavity (16) in said driver sleeve (7), a check switch (22) is supported in said housing (4) and movable in a movement direction (9) of said contact bridge (21) flush therewith, said check switch (22) being located at a distance from said contact bridge (21) when the switching device (1) is non-actuated, said check switch (22) being closed by said contact bridge (21) when the switching device (1) is in an actuated condition; wherein closure of said check switch (22) completes an electrical circuit by means of which actuation of the switching device is signalled to a control unit to identify to an operator the switching off of the affected machine among the plurality of machines.

2. A switching device in accordance with claim 1, wherein said check switch (22) comprises two contact pins (24) spaced from one another, said contact pins (24) being connected together electrically by said contact bridge (21) when the switching device (1) is in the actuated condition.

3. The switching device in accordance with claim 1, wherein said contact bridge (21) is supported in the cavity (16) against a force of a spring (17), and the free end of the spring (17) opposite to the contact bridge (21) is disposed in a retaining bush (18) connected to the actuator cap 5.

4. The switching device in accordance with claim 1, wherein said check switch (22) and said contact switch (11) are electrically separated from one another.

* * * * *